United States Patent [19]

Bradshaw

[11] Patent Number: 4,635,374

[45] Date of Patent: Jan. 13, 1987

[54] BOW SIGHT BAR

[76] Inventor: John F. Bradshaw, 14 Garnett Ave., St. Augustine, Fla. 32084

[21] Appl. No.: 786,532

[22] Filed: Oct. 11, 1985

[51] Int. Cl.[4] ..... F41G 1/00; F41B 5/00

[52] U.S. Cl. ..... 33/265; 124/87

[58] Field of Search ..... 33/265; 124/88, 87, 124/23 A

[56] References Cited

U.S. PATENT DOCUMENTS 3,310,875 3/1967 Kowalski ..... 33/265

4,120,096 10/1978 Keller ..... 33/265

*Primary Examiner*—Richard C. Pinkham

*Assistant Examiner*—Gary Jackson

*Attorney, Agent, or Firm*—Arthur G. Yeager

[57] ABSTRACT

A sight bar for an archer's bow comprising a flat Y-shaped plate adapted to be attached to a bow at the stem of the Y and the two arms of the Y connected by a hinge pin on which pivots an L-shaped beam member so that each wall section of the beam may be positioned flush with the Y-shaped plate; structure to adjustably attach a stationary bow sight to one wall section and a pendulum bow sight to the other wall section; and structure to manually clamp the L-shaped beam so that each wall section may be made selectively flush with the Y-shaped plate.

9 Claims, 4 Drawing Figures

BOW SIGHT BAR

BACKGROUND OF THE INVENTION

Archers bows have in modern times become considerably more complicated in structure and operation than the simple combination of a springy length of tough wood and a rawhide thong strung taut across the ends of the wooden bow. Modern bows are made in jointed sections having gears and pulley arrangements to make the bow stronger so as to provide higher velocities to the arrow but with less strength needed by the archer. Similarly, there are bow sights which have been developed for the archer to use in different methods of hunting. For example, the hunter may be on the ground or on an elevated platform in a tree, While on the ground, the hunter uses a pin sight which is adjusted to send an arrow into the target at a specific distance. Hunters may desire two or three of such sights on his bow so he may select the appropriate sight for the distance he judges his target to be. While on a tree platform, the pin sights are inaccurate, if they have been adjusted for ground level shooting. As a result, most hunters prefer a pendulum sight which swings by gravity to automatically adjust the trajectory regardless of whether the line of sight to the target is steeply downward or not so steeply downward.

It is an object of this invention to provide a bow sight bar having both stationary and pendulum bow sights which can be quickly and noiselessly changed from one to another. Other objects will become apparent from the more detailed description which follows.

BRIEF DESCRIPTION OF THE INVENTION

This invention relates to a bow sight bar comprising a substantially flat forked plate having a single support leg at one end thereof and two spaced arms at the other end thereof, an L-beam portion having two wall sections at substantially right angles with each other and joined along a corner, a hinge means connecting the extremities of said two spaced arms and said L-beam portion corner, means for attaching a stationary bow sight to one of said wall sections, means for attaching a pendulum bow sight to the other of said wall sections, a stop arm adapted to contact said wall sections in either of two operative positions for bow sighting, and means to clamp said walls against said stop arm.

In specific embodiments of this invention the L-beam portion is hinged so as to pivot through 90° to positions where the L-beam portion may be manually clamped to the stop means quickly and noiselessly to bring into operative position whichever bow sight is selected.

BRIEF DESCRIPTION OF THE DRAWINGS

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
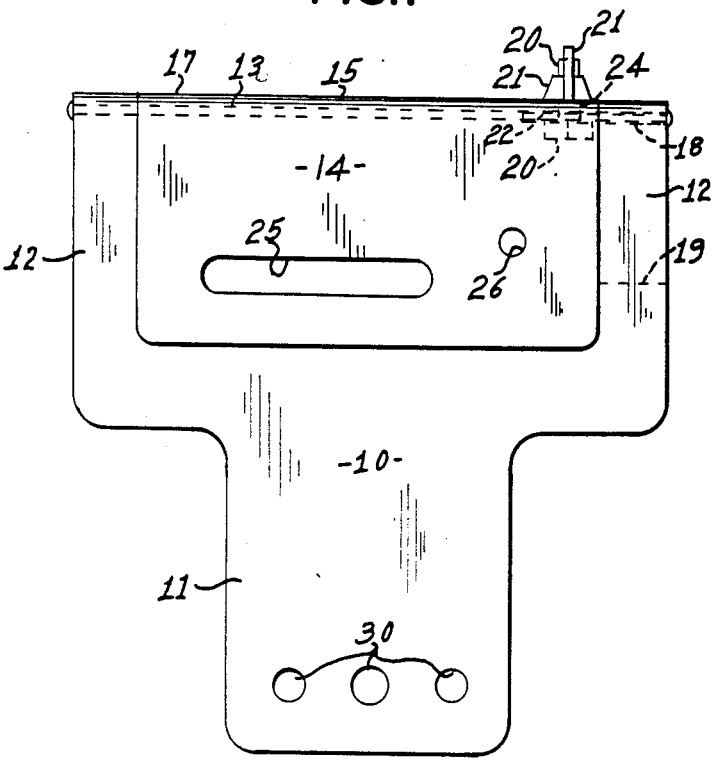
FIG. 1 is a front elevational view of the bow sight bar of this invention.

This invention relates to a device known as a "bow sight bar" which is attachable to an archer's bow for purposes of attaching two types of bow sights, one of which is used when the archer and the target are at about the same elevation, and the other of which is used when the archer is at a substantially higher elevation than the target. Since deer hunters using bow and arrow may have need for both types of bow sights, it is the purpose of this invention to provide a bow sight bar having both types of sights attached and previously calibrated and which can rapidly and noiselessly be moved to select either sight for shooting.

In the attached drawings there can be seen the features of this invention. The bow sight bar includes a substantially flat forked plate 10 having a Y-shape with a stem portion 11 and two spaced arms 12. A hinge pin 13 is attached to the extremities of arms 12 and extends across the space between arms 12. Pivotally attached to hinge pin 13 is an L-beam section 14 having a first wall section 15 and a second wall section 16 which are joined along a backbone 17 through which hinge pin 13 passes. Thus L-beam section 14 rotates around backbone 17 such that wall sections 15 and 16 can selectively be positioned to be flush with or an extension of Y-shaped plate 10.

Stop arm 18 projects outwardly from Y-shaped plate 10 so as to permit L-beam section 14 to pivot through 90° and then to contact stop arm 18 to prevent pivoting beyond the 90° Stop arm 18 contacts wall section 15 at one extreme of the 90° and wall section 16 at the other extreme of the 90° Stop arm 18 is rigidly attached to one of arms 12 by any convenient means, the one shown here is to have stop arm 18 a portion of an L-shaped structure with leg 19 bolted, riveted, welded, or soldered to arm 12 leaving arm 18 to project outwardly.

A clamping means is employed to hold one or the other of wall sections 15 and 16 against stop arm 18. The means shown here is a bolt 20 and wing nut 21 which are easily tightened and loosened by hand. Hole 22 in stop arm 18 is aligned with either hole 24 in wall section 15 or hole 26 in wall section 16 and bolt 20 is passed through both holes with wing nut 21 tightened thereon to clamp L-beam portion 14 in the selected position.

Figure 4:
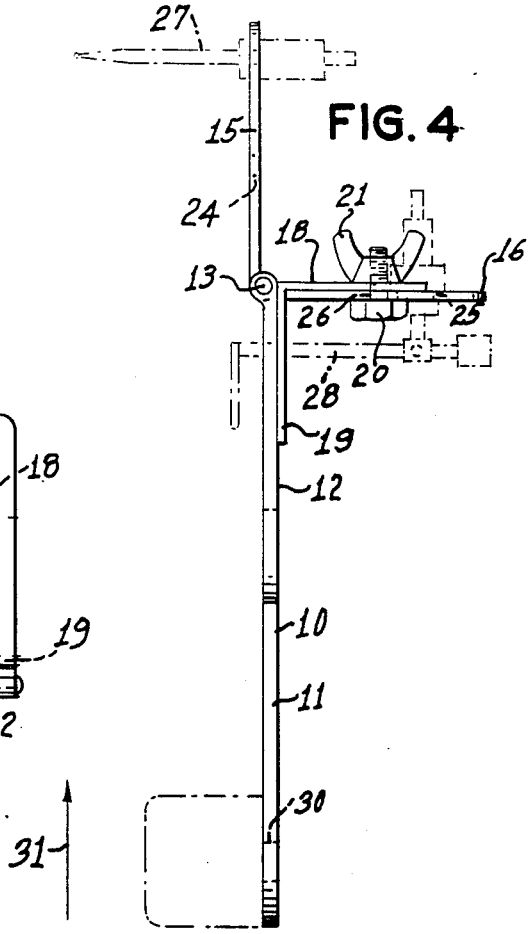
FIG. 4 is a side elevat:onal view of the bow srght bar of this invention with the stationary sight holder in operative position.

First wall section 15 of L-beam portion 14 is designed to hold the stationary bow sight 27 as shown in dotted lines in FIG. 4. Slot 23 extends lengthwise of wall section 15 to permit adjustment of bow sight 27 to whatever position is desired. Many hunters will employ two or more stationary bow sights adjusted to the proper position for a selected distance to the target. For example, there may be three sights, one for 30 yards, one for 40 yards and one for 50 yards.

Second wall section 16 or L-beam section 14 is designed to hold a pendulum bow sight 28 as seen in FIG. 4. Such a sight rotates automatically as the line of sight of the bow is directed up or down from the usual horizontal sighting. Such a sight is needed when the archer is shooting from a tree platform which may be 10–20 feet above the ground requiring the line of sight to be directed downwardly at a substantial angle below horizontal. For such purposes the pendulum sight swings bv gravity to automatically provide the archer with the proper line of sight for shooting.

In FIG. 4 there is shown a cross-section of the bow 29 to which bow sight bar plate 10 is attached. Normally, bows are provided with predrilled holes for attachment of a bow sight bar by means of bolts and nuts. Holes 30 represent such attachment holes. Depending on the manner in which the bow is designed, sight bar plate 10 may be attached on the right or the left side of the bow. In FIG. 4 plate 10 is shown attached to the right side of bow 29 with the line of sighting from the archer's eye to sight 27 being represented by directional arrow 31.

Figure 2:
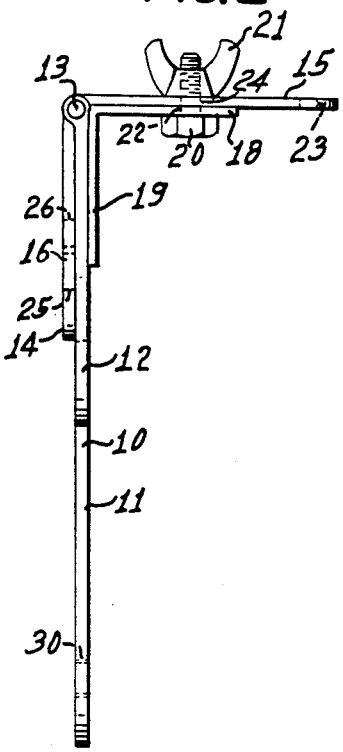
FIG. 2 is a side elevational view of the bow sight bar ot this invention.
Figure 3:
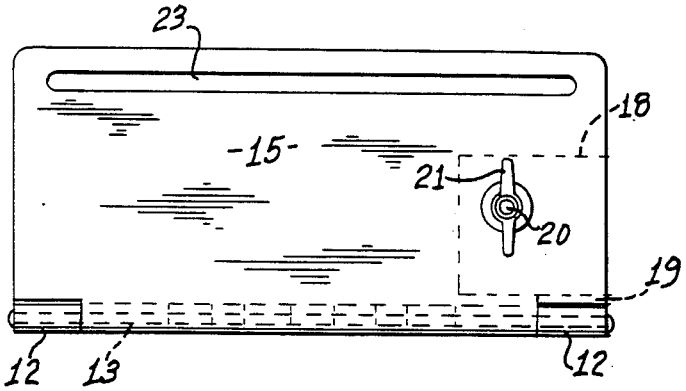
FIG. 3 is a top plan view of the bow sight bar of this invention.

L-beam section 14 is pivotable between the two extremes shown in FIGS. 2 and 4. In the position of FIG. 4, wall section 15 is an extension of plate 10 and stationary bow sight 27 is in position for aiming by the archer. In this position, wall section 16 is clamped against the lower surface of stop arm 18. In the position of FIG. 2, wall section 16 is substantially flush with flat plate 10 and pendulum bow signt 28 is in position for aiming by the archer. In this position wall section 15 is clamped against the upper surface of stop arm 18.

In some bows there may not be a "window" which provides a notch tor the aiming line of sight. In bows witnout a "window" it may be necessary for stem 11 to be offset so as to bring the bow sight away from the bow for easy sighting. When a "window" is provided, stem 11 may be substantially flat with no offset section.

The material from which the bow sight bar of this invention is made is not critical. There are preferred materials, however, which are light weight and will not squeak when pivoted. Aluminum is a preferred metal. Plastics such as polyethylene, polyamide, polyacrylate, etc. are also preferred.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what is desired to be secured by Letters Patent of the United States is:

1. A bow sight bar comprising a substantially flat forked plate having a single support leg at one end thereof and two spaced arms at the other end thereof, an L-beam portion having two wall sections at substantially right angles with each other and joined along a corner, a hinge means connecting the extremities of said two spaced arms and said L-beam portion corner, means for attaching a stationary bow sight to one of said wall sections. a stop arm adapted to contact said wall sections in either of two operative positions for bow sighting, and means to clamp said walls against said stop arm.

2. The bow sight bar of claim 1 wherein one side of said flat forked plate is a sighting surface along which the archer looks in aligning said sights, and the other side of said plate is a non-sighting surface to which said stop arm is attached projecting outwardly from said non-sighting surface.

3. The bow sight bar of claim 2 wherein said L-beam section is capable of pivoting through 90° to place either of said wall section substantially flush with said sighting surface while the other wall section projects outwardly from said non-sighting surface.

4. The bow sight bar of claim 1 wherein each of said wall sections includes slot means for attaching said bow sights adjustably along the length of said slot means.

5. The bow sight bar of claim 1 wherein said means to clamp includes manually tightenable bolt and nut means.

6. Tne bow sight bar of claim 1 wherein said single support leg includes means for attachment to a bow.

7. A bow sight bar comprising a substantially flat Y-shaped plate having a broad stem portion adapted to be attached to a bow and two widely spaced narrow arm portions, a hinge pin attached to each said arm portions and extending across the space between said arm portions; an L-shaped beam member having two wall sections joined along a backbone with said backbone being pivotally attached to said hinge pin so that either of said wall sections may be positioned to be flush with said Y-shaped plate; a slot in one of said wall sections for adjustable attachment of one or more stationary bow sights thereto; a slot in the other of said wall sections for adjustable attachment of a pendulum bow sight thereto; a stop means attached to said Y-shaped plate for engagement with said L-shaped beam member when either of said wall sections is positioned to be flush with said Y-shaped plate; and clamp means to hold either of said wall sections in the selected position.

8. The bow sight bar of claim 7 wnerein said stop means comprises an arm projecting outwardly from said Y-shaped plate and adapted to contact said pivotable wall sections.

9. The bow sight bar of claim 7 wherein said clamp means comprises bolt and nut means.

* * * * *